US005427180A

United States Patent [19]

Leite et al.

[11] Patent Number: 5,427,180

[45] Date of Patent: Jun. 27, 1995

[54] SYSTEM FOR TENSIONING RISERS BY MEANS OF ARTICULATED GRID

[75] Inventors: André Jacques de Paiva Leite, Rio de Janeiro; Edwal F. Paiva Filho, Niteroi, both of Brazil; David Cardellini, Huntington Beach; Jeffrey P. Taylor, Trabuco Canyon, both of Calif.

[73] Assignees: Petroleo Brasileiro S.A.-Petrobras, Rio de Janeiro, Brazil; Paul Munroe Engineering, Orange, Calif.

[21] Appl. No.: 230,204

[22] Filed: Apr. 20, 1994

[30] Foreign Application Priority Data

Apr. 20, 1993 [BR] Brazil ..... 9301600

[51] Int. Cl.[6] ..... E21B 43/017

[52] U.S. Cl. ..... 166/355; 166/366; 405/224.2

[58] Field of Search ..... 166/355, 367, 366; 405/224.2, 224.4, 224.3

[56] References Cited

U.S. PATENT DOCUMENTS

| | | | |
|---|---|---|---|
| 4,616,708 | 10/1986 | da Mota | 166/355 |
| 4,913,238 | 4/1990 | Danazeko et al. | 166/355 X |
| 4,934,870 | 6/1990 | Petty et al. | 166/355 X |
| 5,330,293 | 7/1994 | White et al. | 405/224.2 X |

FOREIGN PATENT DOCUMENTS

| | | | |
|---|---|---|---|
| 2001034 | 1/1979 | United Kingdom | 405/224.2 |
| 2065197 | 6/1981 | United Kingdom | 166/366 |

*Primary Examiner*—Hoang C. Dang

*Attorney, Agent, or Firm*—Sughrue, Mion, Zinn, Macpeak & Seas

[57] ABSTRACT

Basically the system consists of a supporting structure (1) lying in an opening in floating vessel (9) to which a group of risers (3) is connected running from sea bottom to sea surface, linking undersea oil wells to their respective production trees (5) which lie on floating vessel (9), said supporting structure (1) being provided with ball joints that enable a group of risers (3) to articulate in relation to supporting structure (1), and slide blocks to enable said supporting structure to be connected/articulated to floating vessel (9).

5 Claims, 5 Drawing Sheets

FIG.3
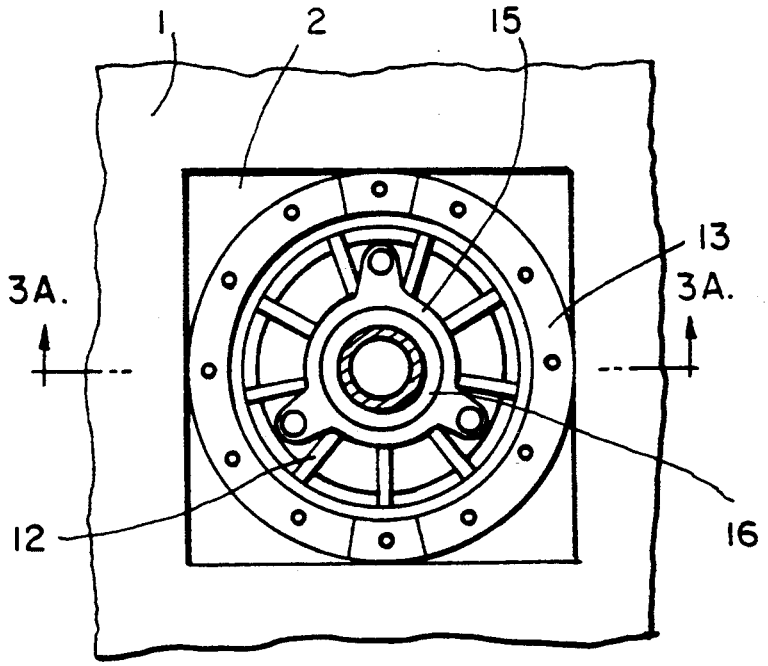
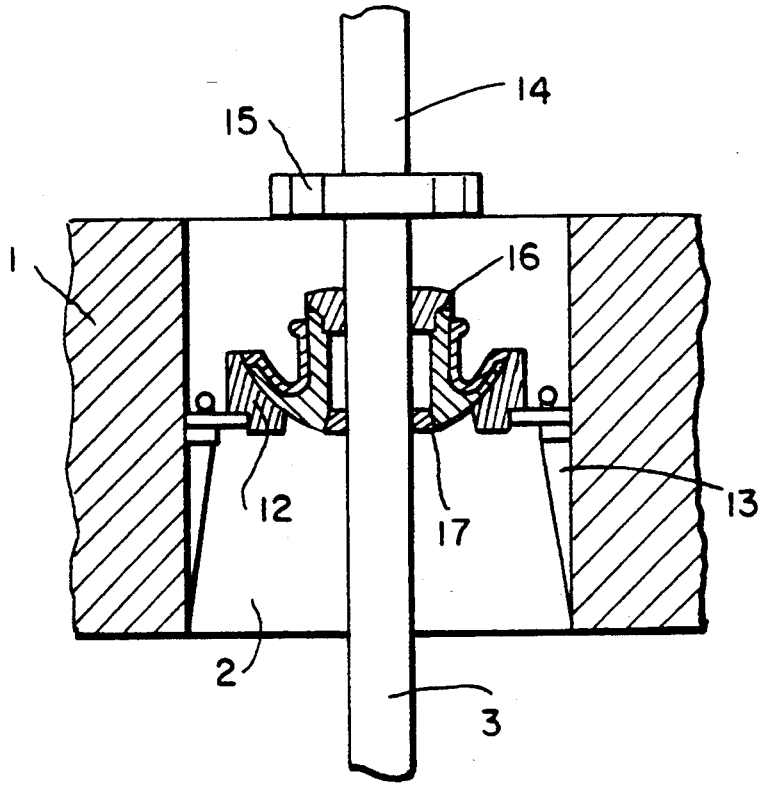
FIG.3A

FIG.4D
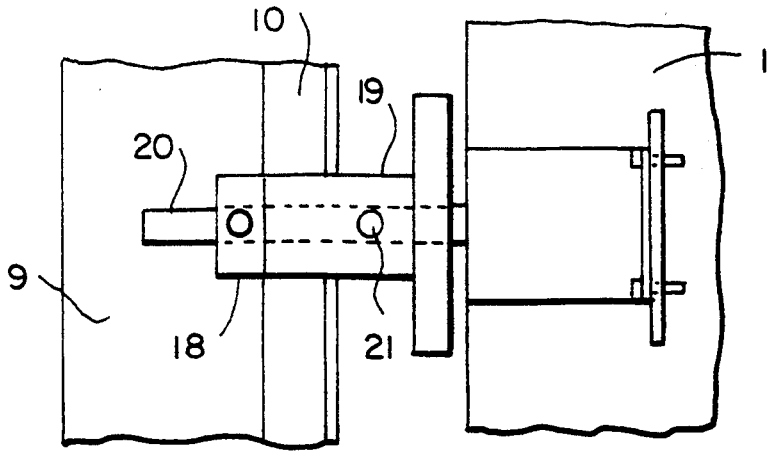
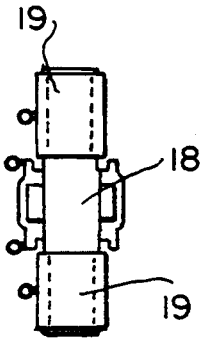
FIG.4A
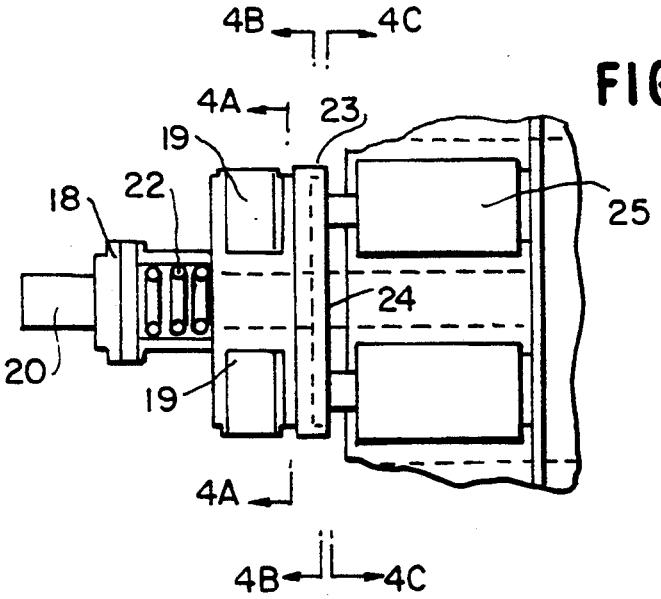
FIG.4
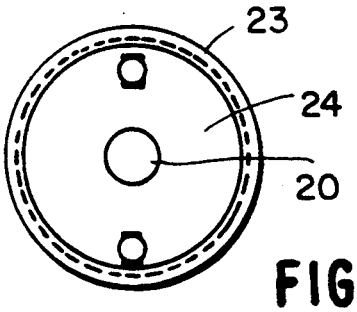
FIG.4B
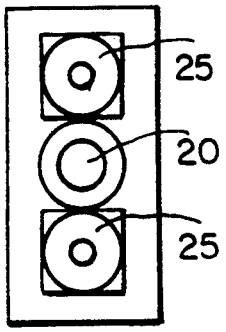
FIG.4C

SYSTEM FOR TENSIONING RISERS BY MEANS OF ARTICULATED GRID

FIELD OF INVENTION

Ever since oilfields have been discovered in deep waters (deeper that 800 meters) a great effort has been made to find ways of working them cheaply and easily.

Among the many alternatives suggested, that of using semisubmersible platforms and risers linking undersea wells to Xmas trees lying afloat has proved to be quite suitable to deal with the flow of oil from such undersea wells. Such risers have however to undergo great strain and twisting caused by environmental forces (waves, wind and ocean currents), as does the platform, all of which may lead to breaking of such risers, serious setbacks to production, threats to the environment, while calling for heavy capital expenditure since sturdier equipment is needed.

This invention concerns a system to tighten the risers used with floating production platforms operating in deep water. It is a system that ensures an almost constant tension being applied to the top of the risers while at the same time compensating for the swaying of the platform.

STATE OF THE ART

Various systems for tensioning platform risers are known, however in most of them each riser is dealt with individually. An example of this kind of system has been described in U.S. Pat. No. 4,616,708 of Oct. 14, 1986. A weight relieving structure is set up on the platform, which has been fitted with several pulleys over which pass the cables that are to tighten each riser, and there is also a clamp placed around each riser so as to enable each riser to move up and down. The system is also provided with side stops to prevent each clamp from turning round in relation to the riser, if the latter comes adrift from its base.

Another kind of system has been revealed by Paive Leite, A. J.—"An alternative FPS concept for offshore oil production"—22nd Annual OTC, Houston, Tex., May 7–10, 1990—pp. 59–68

In this system the risers are grouped together within a structure shaped like a grid and the grid is then tensioned. This arrangement works along with a semisubmersible platform, anchored and designed to meet the following requirements: cheaper to build, optimized dimensions, arrangement of space and safety, due regard being had for environmental restrictions called for, so that all relative movement between risers and platform is adsorbed and offset.

Though this system is quite satisfactory there are in actual fact some disadvantages to it, as for instance, the lack of a lateral guiding system to centralize the grid in relation to the opening in the platform—the-moon-pool—and also that would allow for relative angular movement between said grid and the platform structure itself.

Another shortcoming of this system is the lack of a device that would enable the tension on each riser to be independently applied, as well as the lack of a handling system for the tools and connectors used in installing the risers, when wells are being completed or work done within them.

The invention herewith applied for introduces substantial modifications in the system described above and is meant to get rid of the shortcomings referred to.

SUMMARY OF THE INVENTION

This invention concerns a system for tensioning risers that stretch from the sea bottom up to the surface of the sea, whereby such risers are grouped together within a supporting structure, being arranged in a circle around a central opening lying within the said supporting structure. Said structure acts together with a floating vessel (or platform) thereby enabling said structure to move vertically within an opening—moon-pool—within the floating vessel and to tilt in relation to any horizontal plane, and it is linked to the floating vessel by means of a series of tensioners arranged around said supporting structure.

BRIEF DESCRIPTION OF THE DRAWINGS

FIG. 3 shows how the top of a riser is connected to the supporting structure invented.

FIG. 4 shows how supporting structure acts in relation to floating vessel.

DETAILED DESCRIPTION OF INVENTION

Floating structures are subject, basically, to two kinds of movements, namely, quasi-static and dynamic motions.

Quasi-static motions are those that bring about horizontal shifting of the floating vessel, caused by ocean currents and winds, as well as any tilt of the floating vessel, caused principally by damage to its hull (for instance, flooding of a tank) together with the force of the wind.

Dynamic motions are those caused by waves, all six kinds of them. Them most significant of these motions with respect to compensating for forces that act upon the structure, is the heave. Other motions such as rolling and pitching are less important since in this invention the risers lie around and close to the middle of the structure. With respect to surging and swaying motions, these can be dealt with as a percentage shift from the horizontal and classed as quasistatic motion, while yawing, since it is never very great, can be neglected.

The applicant has developed a computer program whereby, by simulating environmental conditions, it assesses the behaviour of the supporting structure in relation to the floating vessel and also to its component parts and risers. Surrounding circumstances are set in keeping with the design also prepared by applicant and approved by ABS Classification Society (American Bureau of Shipping). This is intended to cover all kinds of harmful environmental forces and damages, whether to the floating vessel, the supporting structure or its components as well as the risers.

Basically the system invented consists of a conventional deck structure as seen on floating vessels (or oil production platforms), which is provided with a central opening, referred to as a moon-pool, in which the supporting structure for the group of risers lies, which risers link the undersea wells to their corresponding production trees. The supporting structure referred to in this invention is that shown in detail in FIG. 1, and it can be of any shape, provided such shape is suitable for the moon-pool in the floating vessel.

It should be mentioned that in order to make it easier to understand the drawings attached hereto, our description thereof only deals with parts directly connected with those in question, the existence of other parts needed to operate the equipment being taken for granted and widely known in the oil business and therefore to those engaged therein. Likewise for the sake of clarity in these drawings we have left out given details concerning certain conventional pieces of equipment.

Figure 1:
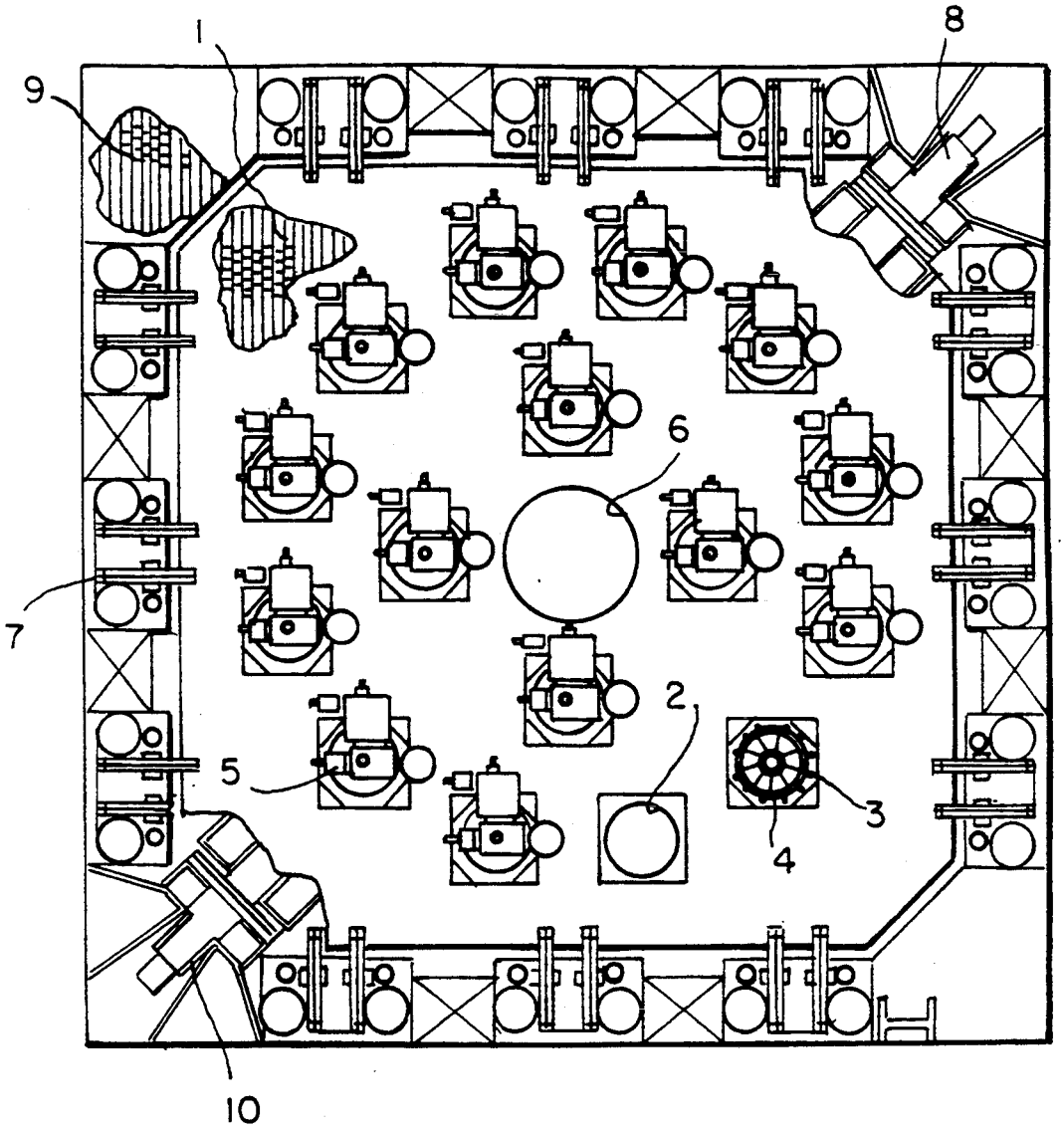
FIG. 1 shows the supporting structure as invented and its position in relation to the floating vessel.

As seen in FIG. 1, the supporting structure (1) is provided with many openings (2) for risers (3) to pass vertically through them, a means (4) to connect the top of each riser to said supporting structure (1), a means to connect production trees (5) to their corresponding undersea well, a moon-pool (6) to enable special tools used for assembly work to be passed, and which leads to a lower retracting deck (shown in FIG. 5) fitted with a track that is used for the handling and use of tools needed to install risers, with a means (7) to allow for tensioning the supporting structure (1) and for the compensating of movements of the floating vessel (9), and a means (8) to enable said supporting structure (1) to act in relation to said floating vessel (9).

Figure 2B:
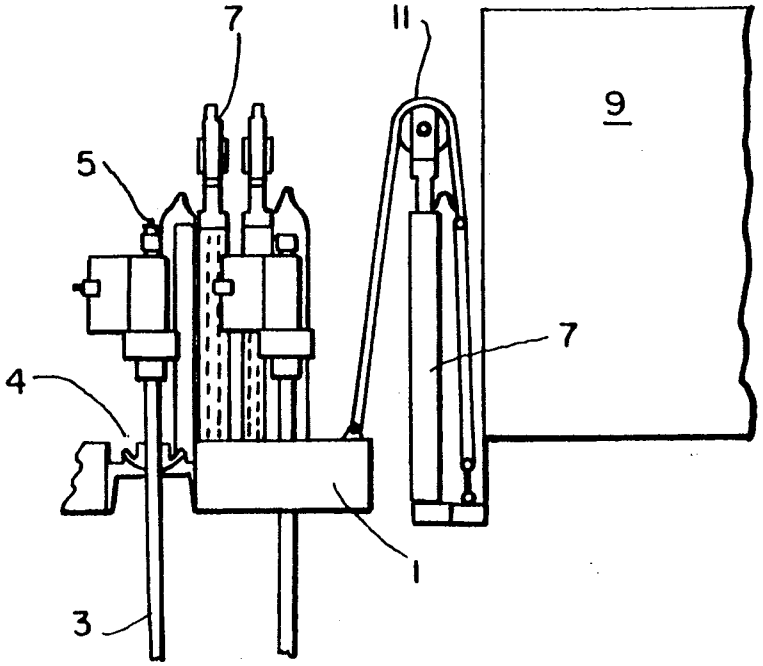
FIGS. 2A and 2B are part section view of the invention system, showing supporting structure under maximum vertical displacement (FIG. 2A) and minimum vertical displacement (FIG. 2B).
Figure 2A:
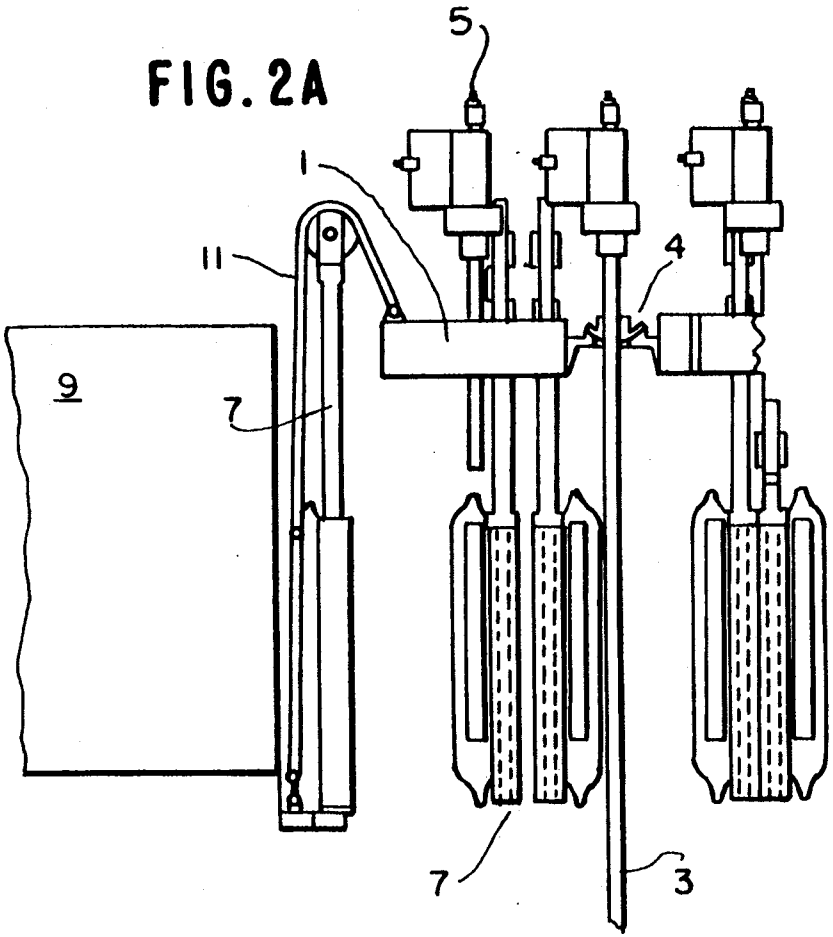

FIGS. 2A and 2B show how tensioning and compensation of vertical movement of the supporting structure (1) is done, while FIG. 4 shows how supporting structure (1) acts in relation to horizontal plane.

Supporting structure (1) in FIG. (1) shows 16 producing wells arranged in a circle around moon-pool (6), however this number is not to be regarded as a limiting factor of the invention. A set of compensators/tensioners (7) are arranged around the supporting structure (1), in the case in point there are 12 pairs of hydropneumatic tensioners.

FIGS. 2 consists of a part section views of the compensating/tensioning system invented, in which the supporting structure (1) of the risers (3) is at the maximum vertical limit of its travel (FIG. 2A) and minimum vertical limit of its travel (FIG. 2B).

As seen, supporting structure (1) is connected to the floating vessel (9) by means of pneumatic tensioners (7), operated by chains (11) running from points on the floating structure (9) to said supporting structure (1). Floating vessel (9) can thus be subjected to vertical and angular movements in relation to the supporting structure (1), while the hydropneumatic tensioners (7) referred to in FIG. 1 keep tension on supporting structure (1) almost constant, and consequently on risers (3). Therefore risers (3) will be free from such movement of the floating vessel (9), since they are connected to the supporting structure (1).

The other directly opposite corners of the supporting structure (1) are provided with a moving system (8) of sliding joints that run inside next to the lateral guides (10) lying in the floating vessel structure (9), as shown in FIG. 1. This system which moves with the aid of sliding joints is shown in detail in FIG. 4.

The articulating system (4) which enables risers (3) to pivot in relation to the supporting structure (1) as shown in FIG. 3 consists basically of a ball joint (12) resting on a stop (13) lying inside opening (2) through said supporting structure (1) through which riser (3) passes vertically.

Connection between such ball joints (12) and riser (3) in turn takes place by means of a riser spool piece (14), which is threaded so as to enable the tension on each riser (3) to be individually adjusted, as the well as final length of such risers (3), because of elastic elongation of the metal of which they are made. To carry out such adjustment a portable hydraulic tool is used (not described herein), coupled to an adjusting ring (15). After riser (3) has been installed and necessary adjustments made for tension and length, the riser (3) is locked on to said ball joint (12) by means of upper locking nuts (16) and lower locking nuts (17).

This kind of connection is a great advance over on that of prior art, since it allows risers (3) to move freely in relation to the supporting structure (1). It makes it easier to centralize risers and also follows vertical and tilting movements of supporting structure (1) in relation to floating vessel structure (9), thereby considerably diminishing strain.

A big advantage of this kind of connection is to be seen when risers tilt in relation to the supporting structure, since it has been designed to allow the risers to tilt at angles of up to 13 degrees in relation to the supporting structure, and to bear loads in the range of 250 tons (550 kips) without needing to change dimensions of openings in supporting structure, which are of a standard size, and likewise, the joint use of the adjusting rings (15) and portable hydraulic tool already referred to, allow for the fine adjustment of tension on risers during work, without needing to withdraw the Christmas tree or use of use a crane.

As shown in FIG. 4, the moving system (8) between supporting structure (1) and floating vessel (9), which enables said riser (3) supporting structure (1) to tilt in relation to any horizontal plane, consists of a pair of sliding blocks—lengthwise (18) and crosswise (19)—in the shape of a cross, installed at points directly opposite said supporting structure (1), and which move inside the lateral guides (10), lying in corresponding inside corners of the moon-pool of the floating vessel (9). Such sliding blocks are provided with dampeners, to allow for these two structure to be constantly in contact and to make it easier for one structure to slide in relation to the other.

The lateral guides (10) are coated with an anti-friction anti-sparking substances, which is easy to replace and maintain.

The lengthwise (18) and crosswise (19) sliding blocks are borne by round spindles (20, 21) so as to enable structure (1) to rotate and translate in relation to the sliding blocks, which should be in permanent contact with the lateral guides (10). Such spindles are free to turn in relation to the sliding blocks (18, 19), while in the case of the lengthwise spindle (20), it is also free to translate axially which can happen if floating vessel (9) or supporting structure is (1) tilted.

A set of preloaded springs (22) fitted into the lengthwise sliding block (18) ensures permanent contact between it and lateral guide (10). At the back of the crosswise sliding blocks (19) there is a flanged disk (23) inside which a flat disk (24) turns and to which two heavy duty shock absorbers (25) are connected, which cause crosswise sliding blocks to be in permanent contact with lateral guide (10), even when supporting structure (1) is rotating around longitudinal axis (20). These shock absorbers (25) also serve to absorb the shock of any sudden load caused by unexpected damage to a riser (3) or to a tensioner (7).

These and other measures usually employed to protect structures, and which may be adapted to the system for the same purpose are to be regarded as within the scope of this invention.

Figure 5:
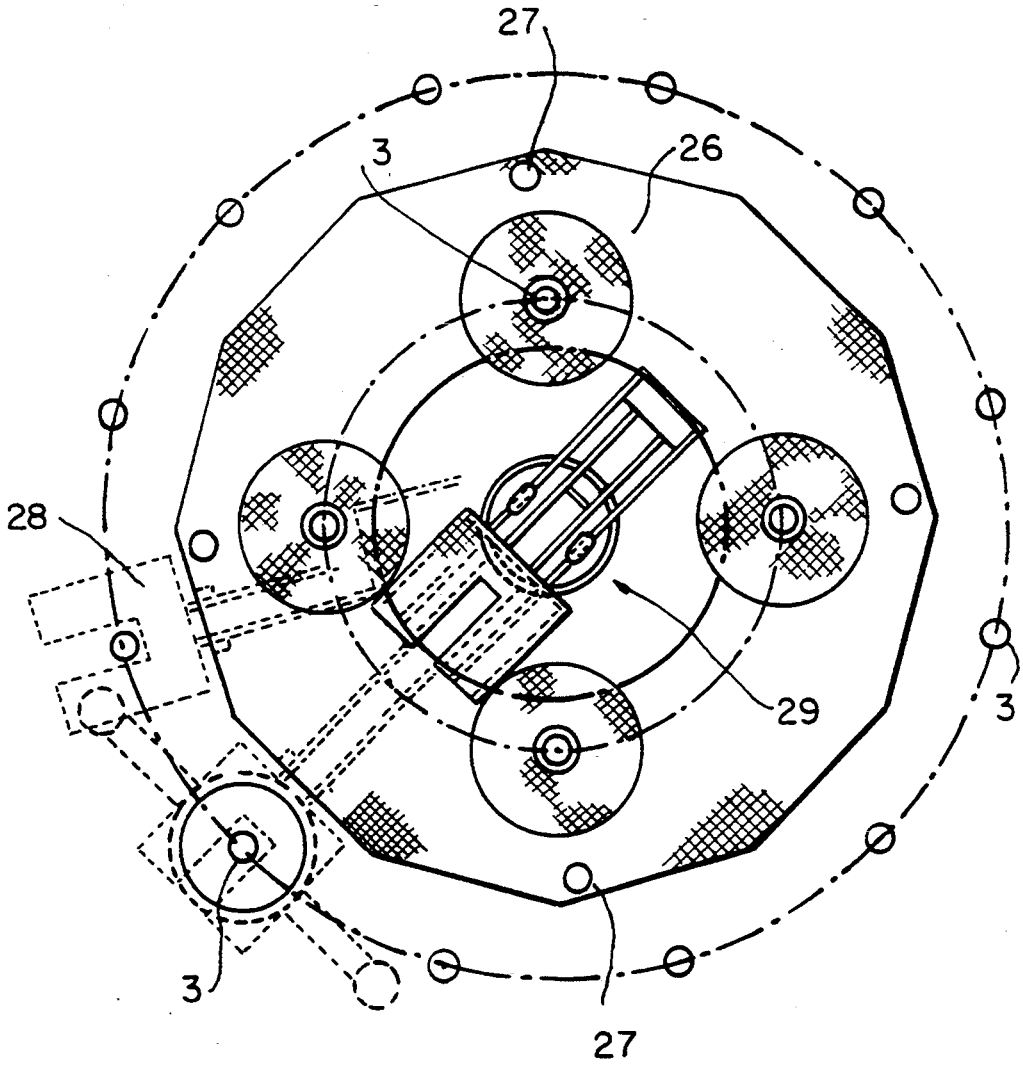
FIG. 5 shows the retracting operational deck.

FIG. 5 shows, in detail, retracting operating deck (26) referred to previously, which lies below the supporting structure (1) for the risers (3) and which can be arrived at through the moon-pool of said supporting structure (1). Such retracting deck (26) is retracted mechanically, its travel up or down being governed by guiding beams (27) which cross it. Access to risers (3) is gained by means of a working platform which travels on rails (29), said platform (28) being brought next to each riser (3) that has to undergo attention.

The big advantage of this retracting deck (26) is that connectors and tools for the installing of risers (3) can be lowered into place, with the aid of such rotating track.

Not only design of compensating/tensioning system has been studied as regards operation thereof but also a computer program has been developed by the applicant for such purpose. Such program enables the vertical static forces that act the articulating system of the supporting structure for the risers and the components of the latter to be analyzed. The risers and the tensioners are treated as if they were nonlinear springs, modelled in terms of their characteristic curves.

Such program enables aforesaid data to be analyzed simultaneously, and each riser and tensioner of supporting structure to be modelled separately, and interactive forces are balanced on the basis of individual force curves for risers and respective reactions of tensioners.

Once all input data has been provided the computer turns out final guidance for supporting structure in terms of vertical travel, angle of slope, direction of slope, etc.

Though the system to compensate movement and for tensioning the supporting structure for risers can be monitored and wholly governed by a hydropneumatic control panel, a special monitoring system has been developed to aid operation and for any remedial action that might have to be taken in the event of damage. Therefore there are sensors installed on the risers, on the supporting structure and in the moon-pool of the floating vessel, where the tensioners lie. Data (angle of supporting structure and of tilt in relation to the horizontal as well as tension on each riser) are collected and there is a control center equipped with recorders and alarm systems.

All the adjustments needed for the system are made normally by means of valves worked by an operator in the control room or by means of portable tools that act upon each riser individually.

To further help work, said special system with its microcomputers and the central control report on performance of the system and suggest action that should be taken.

What is claimed is:

1. System for tensioning risers by means of an articulated grid, which risers stretch from sea bottom up to sea surface, linking undersea wells to their respective production trees which lie on a floating vessel, wherein a supporting structure (1) lies within an opening in the floating vessel (9) to which a group of risers (3), arranged in a circle around a moon-pool are connected, by means of an articulating system (4) lying inside openings (2) provided in said supporting structure (1) for risers (3) to pass vertically therethrough, and which enable each riser (3) to pivot in relation to said supporting structure (1), while said supporting structure (1) is connected to the floating vessel (9) by means of tensioners (7), worked by chains (11) running from points on the floating vessel structure (9) to said supporting structure (1), and arranged around said supporting structure (1), enabling said supporting structure to move vertically in relation to said floating vessel (9), and said supporting structure being provided with a moving system (8) comprised of sliding blocks (18, 19) operatively connected between said vessel and said supporting structure, that enable said supporting structure to tilt in relation to any horizontal plane.

2. System for tensioning risers by means of an articulated grid, according to claim 1, wherein the articulating system (4) that enables said risers (3) to move in relation to said supporting structure (1) consists basically of a ball joint (12) resting on a stop (13) lying inside said opening (2) for said risers to pass vertically through within said supporting structure (1), which ball joint (12) is crossed by said riser (3) which is fixed to the riser by means of upper (16) and lower (17) locking nuts.

3. System for tensioning risers by means of articulated grid, according to claim 1, wherein said moving system (8) allows said riser (3) supporting structure (1) to tilt in relation to any horizontal plane, consisting of longitudinal sliding blocks (18) and transversal ones (19) in the shape of a cross, installed at directly opposite points of said supporting structure (1) which slide inside the lateral guides (10) lying at corresponding inside corners of said floating vessel opening (2) which sliding blocks (18, 19) are borne on round spindles (20, 21) that enable said supporting structure (1) to rotate and translate in relation to said sliding blocks (18, 19) and which is provided with means to ensure that said supporting structure (1) is in constant contact with said floating vessel (9).

4. System for tensioning risers by means of an articulated grid, according to claim 1, wherein said moon-pool (6) in said supporting structure (1) enables access to be had to a retracting operating deck (26) lying below said supporting structure (1), so that portable tools to adjust tension on each riser (3), individually, can be passed, whenever required, during the course of work, without needing to remove any Xmas tree and without the help of a crane.

5. System for tensioning risers by means of articulated grid, according to claim 4, wherein said retracting operating deck (26) lying below the supporting structure (1) moves up or down mechanically and is guided by guiding beams (27) that cross said retracting operating deck and being provided with a working platform (28) that runs on a rotating track (29) so as to enable said retracting operating deck to be brought next to each riser (3).

* * * * *